US005842101A

United States Patent [19]

Harada

[11] Patent Number: 5,842,101

[45] Date of Patent: Nov. 24, 1998

[54] AUTOMATIC DOCUMENT FEEDER

[75] Inventor: Hiroyuki Harada, Osaka, Japan

[73] Assignee: Mita Industrial Co., Ltd., Osaka, Japan

[21] Appl. No.: 895,480

[22] Filed: Jul. 16, 1997

[30] Foreign Application Priority Data

Jul. 17, 1996 [JP] Japan ..... 8-187187

[51] Int. Cl.[6] ..... G03G 15/00

[52] U.S. Cl. ..... 399/368; 399/43

[58] Field of Search ..... 399/43, 204, 367, 399/368; 271/3.01, 3.12, 8.1; 355/75

[56] References Cited

U.S. PATENT DOCUMENTS 5,559,594 9/1996 Ohhata et al. ..... 399/43 X 5,576,823 11/1996 Kakuta et al. ..... 399/367

FOREIGN PATENT DOCUMENTS 6-51588 2/1994 Japan .

*Primary Examiner*—Arthur T. Grimley

*Assistant Examiner*—Sophia S. Chen

*Attorney, Agent, or Firm*—Antonelli, Terry, Stout & Kraus, LLP

[57] ABSTRACT

An automatic document feeder for feeding documents borne on a document bearing table to an exposure position includes a two-document exposure setting switch for setting the conveyance of two documents to the exposure position and the simultaneous exposure of the two documents, and a controller. The controller controls the first and second documents fed from the document bearing table so that they are conveyed to the exposure position with the rear end of the first document and the front end of the second document overlapping by a predetermined amount.

7 Claims, 11 Drawing Sheets

AUTOMATIC DOCUMENT FEEDER

FIELD OF THE INVENTION

This invention relates to an automatic document feeder which feeds to a document exposure position sheets of documents put in an electrostatic copying machine or the like.

DESCRIPTION OF THE PRIOR ART

In recent years, with the speeding and automation of copying, copying machines have been equipped with an automatic document feeder which automatically feeds a plurality of documents sequentially to a document exposure position (document setting position) on the top of a transparent platen. This type of automatic document feeder comprises a document bearing means for bearing documents; a document sending-in means for feeding one at a time the documents borne on the document bearing means; a register roller pair disposed downstream of the document sending-in means to temporarily stop the document carried by the document sending-in means and then to carry the stopped document toward an exposure position; and a document conveying means for conveying the document, carried by the register roller pair, to the exposure position. The copying machine equipped with such an automatic document feeder has a structure in which the automatic document feeder feeds one document to a document exposure position on the top of a transparent platen, discharges this document from the document exposure position after completion of an exposure action, and also feeds a next document to the document exposure position.

The prior automatic document feeder described above feeds documents one by one to the document exposure position on the top of the transparent platen, so that it is unable to expose two documents simultaneously for their copying onto a sheet of transfer paper (hereinafter referred to as a transfer sheet). In setting documents manually, it has been practiced, for example, to arrange two A4-size documents side by side on the transparent platen, and perform a copy action, to copy the two documents on an A3-size transfer sheet, or to copy two documents in a reduced size on a transfer sheet of a predetermined size. As a technology taking these facts into consideration, Japanese Patent Publication No. 83457/93 discloses an automatic document feeder with a so-called "two-in-one function" in which two documents are fed onto a transparent platen and copied simultaneously.

In the technology described in the publication, the two documents are conveyed onto the transparent platen with the front end of the second document in contact with or in proximity to the rear end of the first document. However, the problem remains that even when the rear end of the first document and the front end of the second document are in contact, a slight gap exists between them, and at the time of exposure the shadow of the rear end of the first document appears vertically as a so-called black line at the center of the transfer sheet.

SUMMARY OF THE INVENTION

A main object of this invention is to provide an automatic document feeder which can prevent the occurrence of a so-called black line at the interface between two documents that are conveyed to an exposure position on a transparent platen and copied.

To attain the main object, the present invention provides an automatic document feeder comprising a document bearing means for bearing documents; a document sending-in means for feeding one at a time the documents borne on the document bearing means; a register roller pair disposed downstream of the document sending-in means to temporarily stop the document carried by the document sending-in means and then to carry the stopped document toward an exposure position; and a document conveying means for conveying the document, carried by the register roller pair, to the exposure position and discharging the document conveyed to the exposure position;

wherein the automatic document feeder includes a two-document exposure setting means for setting the conveyance of two documents to the exposure position and the simultaneous exposure of the two documents, and a control means for controlling the document sending-in means, the register roller pair, and the document conveying means so as to be actuated; and when the two-document exposure setting means sets the simultaneous exposure of the two documents, the control means controls the document sending-in means, the register roller pair and the document conveying means so as to be actuated, thereby to feed the first document borne on the document bearing means, situate its rear end at a predetermined position between the register roller pair and the document conveying means, and place it in a wait state, then controls the document sending-in means and the register roller pair so as to be actuated, thereby to feed the second document borne on the document bearing means, and situate its front end at a position where the front end overlaps the rear end of the first document by a predetermined amount, and then controls the register roller pair and the document conveying means so as to be actuated, thereby to convey the first and second documents, situating them at the exposure position.

The present invention also provides an automatic document feeder in which when the first document and the second document are conveyed to the exposure position, the control means situates the rear end of the second document downstream of a document setting reference position in the document feeding direction by an amount corresponding to one half of the amount of the overlap.

Further, the present invention provides an automatic document feeder which is equipped with a document overlap amount setting means for setting the amount of overlap between the rear end of the first document and the front end of the second document, and wherein the control means controls the first and second documents so as to be conveyed based on the amount of overlap set by the document overlap amount setting means.

DETAILED DESCRIPTION OF PREFERRED EMBODIMENTS

Preferred embodiments of an automatic document feeder constructed in accordance with the present invention will be described in detail by reference to the appended drawings.

Figure 1:
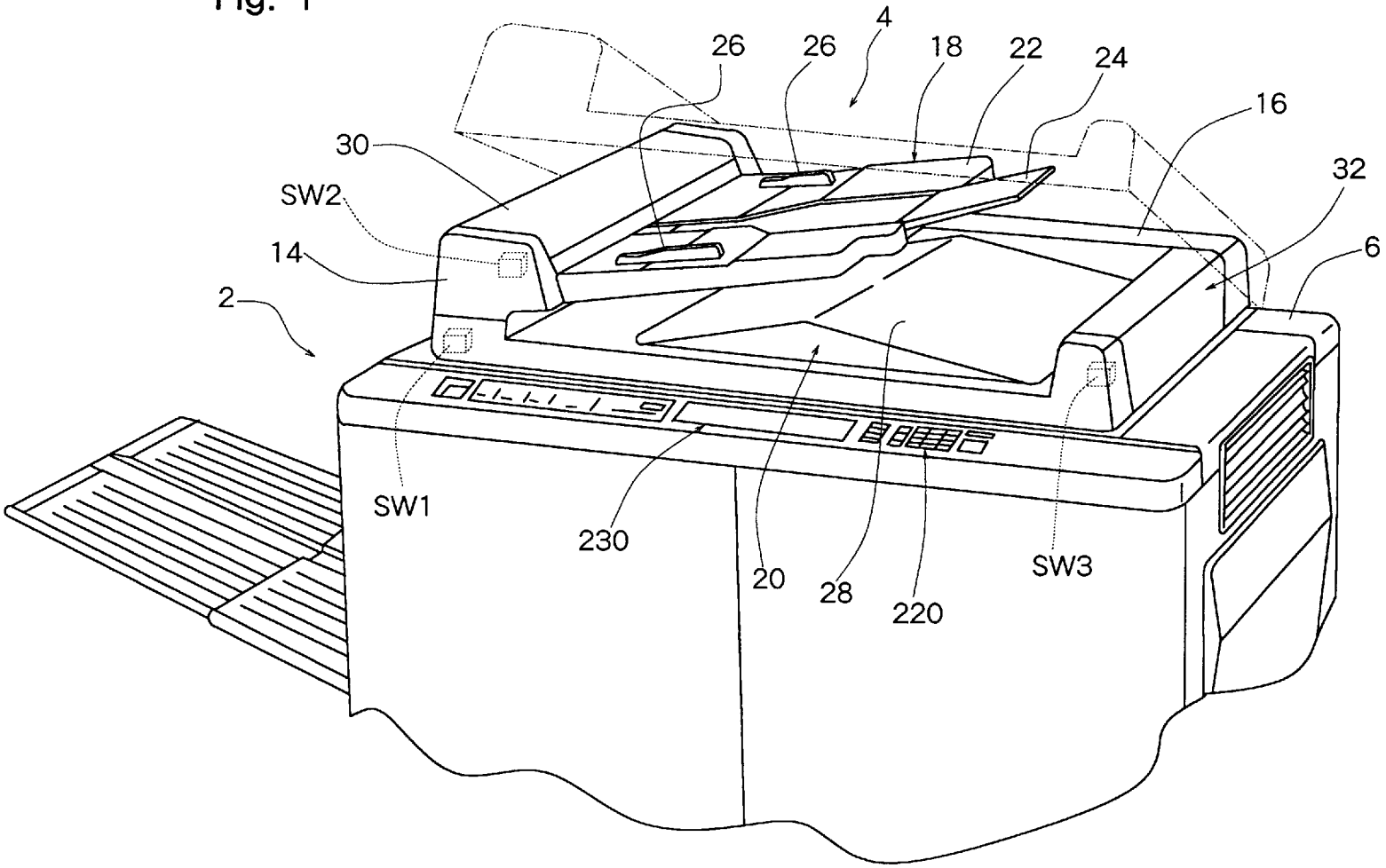
FIG. 1 is a perspective view showing a preferred embodiment of an automatic document feeder constructed in accordance with the present invention and mounted on an electrostatic copying machine.
Figure 2:
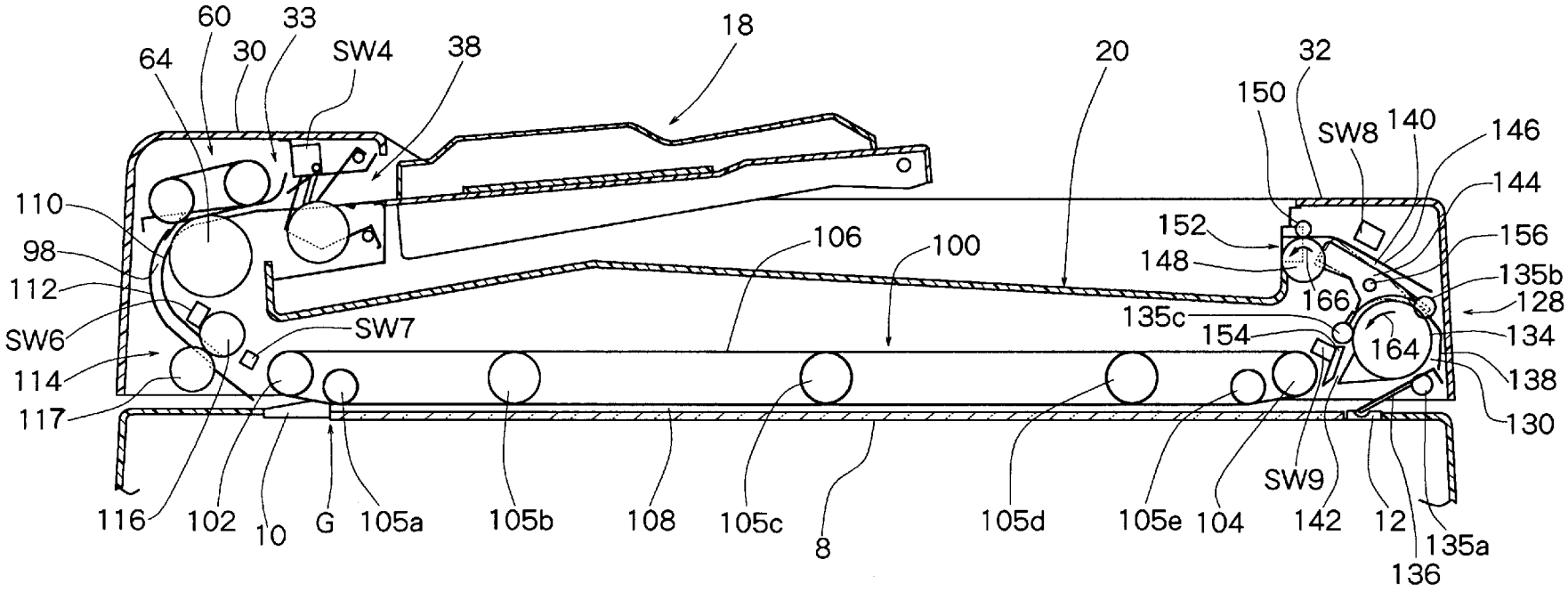
FIG. 2 is a sectional schematic view of the automatic document feeder shown in FIG. 1.

FIGS. 1 and 2 illustrate an upper part of an electrostatic copying machine 2 and an automatic document feeder 4 mounted thereon. The electrostatic copying machine 2 has a housing 6, on top of which is disposed a transparent platen 8 (FIG. 2), optionally a glass plate. On one side of the transparent platen 8 (the left-hand side in FIG. 2), a document restraining member 10 is disposed for determining a reference position for document setting, G. On the other side thereof (the right-hand side in FIG. 2), a stationary mounting member 12 is disposed. The automatic document feeder 4 constructed in accordance with the present invention is mounted on the top of the housing 6 of the electrostatic copying machine 2 so as to be free to pivot between a closed position shown by a solid line in FIG. 1 and an open position shown by a two-dot chain line in FIG. 1 about a pivot axis extending along a rear side edge of the transparent platen 8. When a document is to be laid manually on the transparent platen 8 of the electrostatic copying machine 2, the automatic document feeder 4 is brought to the open position to expose the transparent platen 8, and the document is placed at a required position on the transparent platen 8. Then, the automatic document feeder 4 is brought to the closed position to cover the transparent platen 8 and the document placed thereon. In laying the document on the transparent platen 8, one can set the document at the required position by contacting one edge of the document with a front edge of the document restraining member 10 to bring the one edge of the document to the reference position G for document setting. When the automatic document feeder 4 is used to force documents automatically onto the transparent platen 8 and force them automatically out from there, the automatic document feeder 4 is put to the closed position.

Further with reference to FIG. 1, the illustrated automatic document feeder 4 includes a front cover 14 and a rear cover 16 disposed at spaced apart locations in the front-to-back direction (the direction perpendicular to the sheet surface in FIG. 2). The front cover 14 and the rear cover 16 may be formed of a suitable plastic material. Inside the rear cover 16, a rear supporting base plate (not shown) is disposed, which is mounted, via a mounting mechanism (not shown) optionally of a well-known type per se, on the top of the housing 6 of the electrostatic copying machine 2 so as to be free to pivot. Various constituent elements of the automatic document feeder 4 are supported directly or indirectly by the rear supporting base plate. Between the front cover 14 and the rear cover 16, a document bearing means 18 and a document discharge tray 20 are disposed. The document bearing means 18 comprises a document table 22 extending upwardly inclinedly from the left-hand front end to the right-hand rear end in FIG. 2, and an auxiliary table 24 pivotably mounted on the rear end of the document table 22. On the document table 22, a pair of width regulating members 26 are mounted movably in a width direction. Such a pair of width regulating members 26 are joined together, via a rack and pinion mechanism (not shown) well known per se, of being beneath the document table 22, and are capable moved toward and away from each other in an interlocked manner. The document discharge tray 20 is disposed below the document bearing means 18, and has a document bearing surface 28 shaped like a mountain when viewed in the front-to-back direction (the direction perpendicular to the sheet surface in FIG. 2). Between the left end portions of the front cover 14 and the rear cover 16 is disposed a left end portion cover 30, while a right end portion cover 32 is disposed between their right end portions. Inside the front cover 14, there are disposed a safety switch SW1 for detecting the open and closed states of the automatic document feeder 4, a safety switch SW2 for detecting the open and closed states of the left end portion cover 30, closed states of the right end portion cover 32. These switches are disposed in series, and when the covers are all put to the closed position, and all the switches are shut, an ON signal is sent to a control means to be described later on.

Further with reference to FIGS. 1 to 4, a document sending-in means 33, provided with a forwarding means 38 and a document separating mechanism 60, is disposed downstream of the document table 22. The document sending-in means 33 has a pair of stationary plates 34, 36 extending on the downstream side of the document table 22. Below the stationary plate 34, a forwarding roller 40, constituting a part of the forwarding means 38, is disposed, and the forwarding roller 40 is situated so as to protrude slightly upwardly through an opening 42 formed on the upstream side of the stationary plate 34. Above the forwarding roller 40, a pressing mechanism 44, constituting another part of the forwarding means 38, is disposed. The pressing mechanism 44 is comprised of a shaft 46, disposed pivotably, and a pressing plate 48, one end of which is fixed to the shaft 46 and the other end of which acts on documents 50 inserted onto the stationary plate 34 after being placed on the document bearing means 18. The shaft 46, constituting a part of the pressing mechanism 44, is connected to a solenoid SOL1 via a link mechanism 52, so that when the solenoid SOL1 is energized, the shaft 46 is pivoted in the direction of an arrow 56 against the spring force of a return spring 54; whereas when the solenoid SOL1 is deenergized, shaft 54 is pivoted in the direction of an arrow 58 owing to the spring force of the return spring 54. Thus, the pressing plate 48, attached to the shaft 46, presses the documents 50 inserted onto the stationary plate 34 when the solenoid SOL1 is energized to pivot the shaft 46 in the direction of arrow 56; and the pressing plate 48 is separated from the documents 50 when the solenoid SOL1 is deenergized and the shaft 46 is pivoted in the direction of arrow 58 by the action of the return spring 54. Above the stationary plate 34 is disposed a document setting switch SW4 as a document detecting means. The document setting switch SW4 sends an ON signal as a first signal, when documents 50 are inserted onto the stationary plate 34 after being placed on the document bearing means 18, and an OFF signal as a second signal, when documents 50 are not placed on the document bearing means 18.

The document separating means 60 disposed downstream of the forwarding means 38 is composed of a paper feed roller 64 having a plurality of roller members disposed downwardly of the stationary plate 34 and caused to protrude upwardly through an opening 62 formed in the stationary plate 34; and a separating belt mechanism 66 disposed and opposite the paper feed roller 64. The separating belt mechanism 66 is disposed on the upward side of the stationary plate 36, and consists of a driving roller 67, a driven roller 68, and a plurality of separating belts 69 wound between the driving roller 67 and the driven roller 68 and disposed alternately with respect to the plurality of roller members constituting the paper feed roller 64. Each separating belt 69 is caused to protrude downwardly through an opening 75 formed in the stationary plate 36. The forwarding roller 40, the paper feed roller 64 and the separating belt mechanism 66 are rotationally driven in the directions of arrows 79, 80 and 82, respectively, by a driving means 78 comprising an electric motor M1 and a transmitting mechanism 76 such as a gear mechanism or a transmitting belt mechanism. In the transmitting mechanism 76 constituting the driving means 78, an electromagnetic clutch CLT1 is disposed, which is controlled by the control means (to be described later on) so as to be actuated. To the electric motor M1 is mounted a rotational amount detecting means FG1, such as a rotary encoder or a frequency generator, which constitutes a means of detecting the amount of document conveyance. Pulse signals, as signals for indicating detection thereby, are sent to the control means to be described later on. The so constituted document separating means 60 is adapted to prevent the simultaneous feeding of two or more documents from a stack of documents laid on the document bearing means 18, and to feed only the bottom-most document to a document sending-in path 98 to be described later on.

Figure 3:
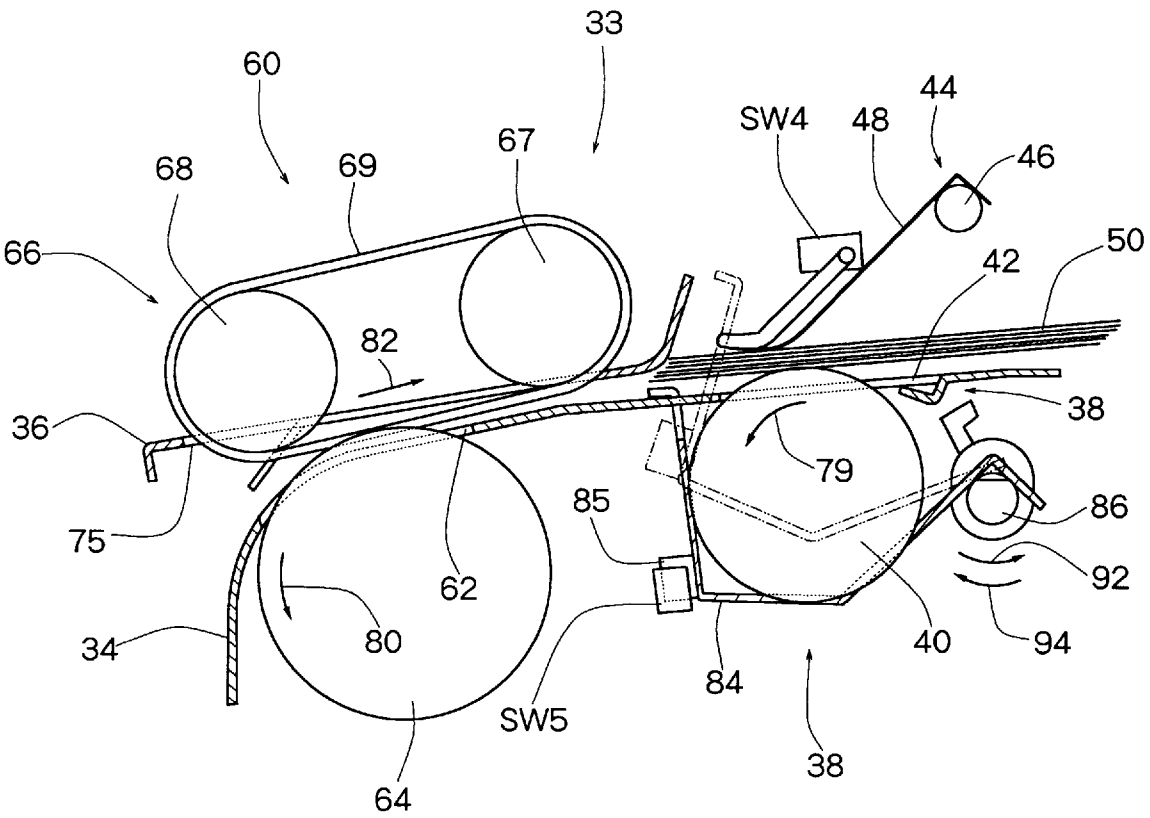
FIG. 3 is an enlarged sectional view of a document sending-in means of the automatic document feeder shown in FIGS. 1 and 2.
Figure 4:
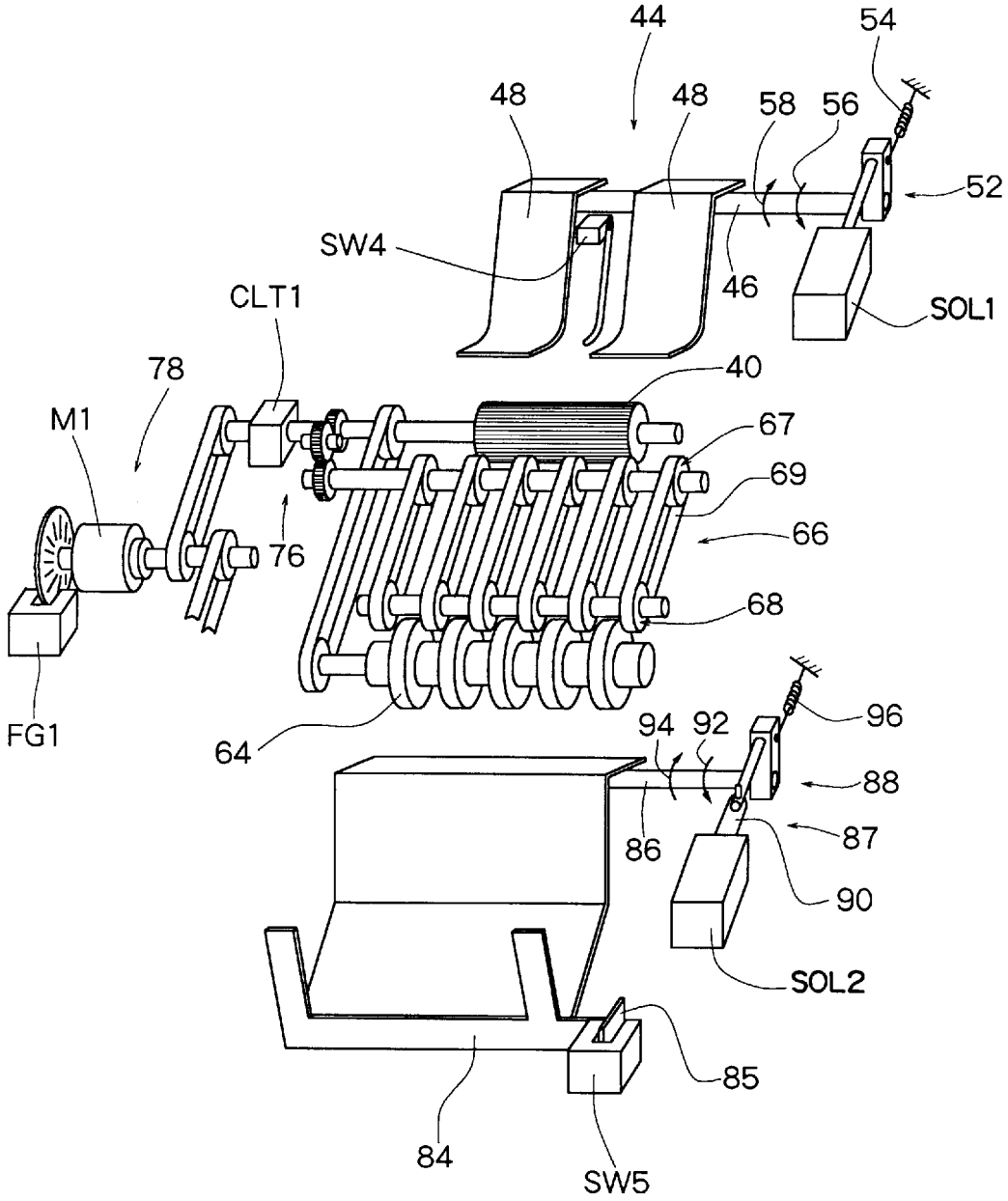
FIG. 4 is a developed perspective view of the document sending-in means shown in FIG. 3.

Between the forwarding means 38 and the document separating means 60, there is disposed a document stopper 84 constituted so as to be operable between an operating position, in which the documents 50 placed on the document bearing means 18 and inserted onto the stationary plate 34 are restrained from being inserted to the document separating means 60 side, and a retreat position, in which the movement of the document 50 to the document separating means 60 side is permitted, as illustrated in FIGS. 2 to 4. The document stopper 84 is disposed on the downward side of the stationary plate 34, with its base end being fixed to a shaft 86 disposed upstream of the forwarding roller 40, parallel with and spaced apart from the shaft of the forwarding roller 40, and the front end of document stopper 84 extends through an opening formed in the stationary plate 34. The shaft 86, with the document stopper 84 attached, is actuated by a stopper driving means 87. The stopper driving means 87 includes a latch type solenoid SOL2, and a link mechanism 88 connecting a plunger 90 of the latch type solenoid SOL2 with the shaft 86. The latch type solenoid SOL2 may be a well known one which has a permanent magnet, an attracting coil and a separating coil inside. When the attracting coil is energized, the plunger 90 is attracted. In this state, when the plunger 90 is attracted by the magnetism of the permanent magnet and the attracting coil is deenergized, the plunger 90 is kept attracted. To separate the plunger 90 from the attracted state, the separating coil is energized to separate the plunger 90 against the magnetism of the permanent magnet. Then, even upon deenergizing of the separating coil, the plunger 90 is kept separated. Thus, when the attracting coil of the latch type solenoid SOL2 is energized to attract the plunger 90, the shaft 86 is pivoted in the direction of an arrow 92, and the document stopper 84 attached to the shaft 86 is brought to the retreat position shown by the solid line in FIG. 3. When the separating coil of the latch type solenoid SOL2 is energized to separate the plunger 90, the shaft 86 is pivoted in the direction of an arrow 94, and the document stopper 84 attached to the shaft 86 is located at the operating position shown by the two-dot chain line in FIG. 3, and held there by the spring force of a return spring 96. To the document stopper 84, a shielding plate 85 is attached, and a stopper position detecting means SW5 is disposed at a position opposed to the retreat position of the document stopper 84 shown by the solid line. The stopper position detecting means SW5 has a light emitting element and a light receiving element, providing the later-described control means with an ON signal as a first signal when the document stopper 84 is placed at the operating position shown by the two-dot chain line, and an OFF signal as a second signal when the document stopper 84 is put at the retreat position shown by the solid line and the shielding plate 85 is positioned between the light emitting element and the light receiving element.

Figure 5:
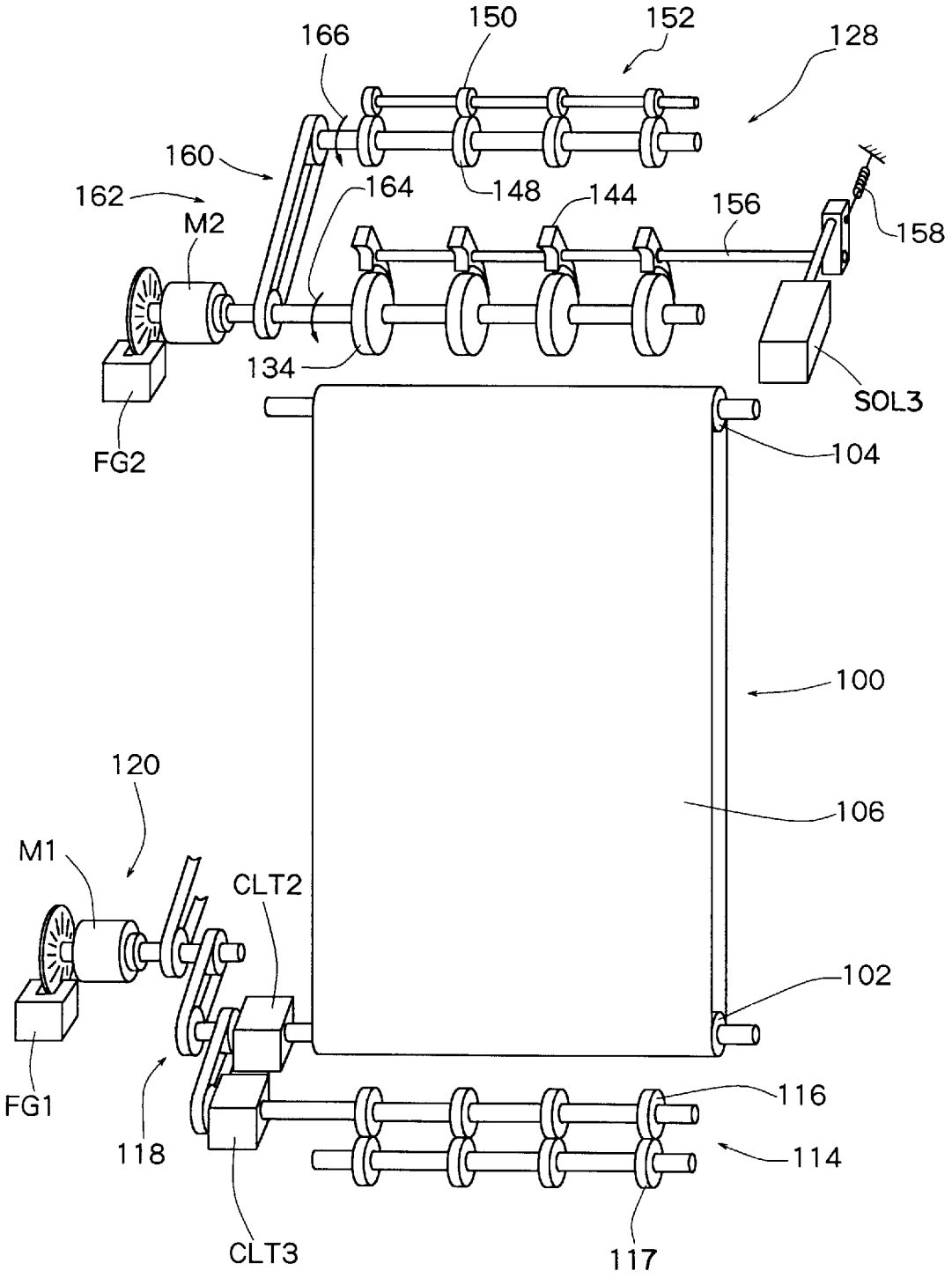
FIG. 5 is a developed perspective view of a conveying belt mechanism and a document reversing/discharging means of the automatic document feeder shown in FIGS. 1 and 2.

With reference to FIGS. 2 and 5, a conveying belt mechanism 100, constituting a document conveying means, is disposed below the document bearing means 18. The conveying belt mechanism 100 includes a driving roller 102 and a driven roller 104 disposed, spaced apart in the conveying direction (the left-to-right direction in FIG. 2), an endless belt 106 wound around these rollers, and rollers 105*a*, 105*b*, 105*c*, 105*d*, 105*e* for rolling which are disposed between the driving roller 102 and the driven roller 104. The lower traveling portion of the endless belt 106 is caused to extend along the transparent platen 8 of the electrostatic copying machine 2, so that a document conveying path 108 is defined between the lower traveling portion and the transparent platen 8. Between such document conveying path 108 and the document separating means 60, a document sending-in path 98 is formed. This document sending-in path 98 is defined between an internal guide plate 110 and an external guide plate 112. On the document sending-in path 98, a register roller pair 114 is disposed. The register roller pair 114 consists of a driving roller 116 and a driven roller 117. On the document sending-in path 98 and upstream and downstream of the register roller pair 114, reflector type optical document detectors SW6 and SW7 are disposed which are each composed of a light emitting element and a light receiving element. These document detectors SW6 and SW7 detect the document 50 passing along the document sending-in path 98 and send a detection signal to the control means to be described later on. The driving roller 102 of the conveying belt mechanism 100 and the driving roller 116 of the register roller pair 114 are rotationally driven by a driving means 120 comprised of the electric motor M1, and a transmitting mechanism 118, such as a gear mechanism or a belt mechanism. In the transmitting mechanism 118 of the driving means 120, electromagnetic clutches CLT2 and CLT3 are disposed which are controlled by the controlling mechanism (to be described later on). The driving roller 102 of the conveying belt mechanism 100 is connected to the transmitting mechanism 118 via the electromagnetic clutch CLT2, while the driving roller 116 of the register roller pair 114 is connected to the transmitting mechanism 118 via the electromagnetic clutch CLT3.

On the right side of the document conveying path 108, a document reversing/discharging means 128 is disposed. The document reversing/discharging means 128 has a first document sending-out path 130, which is defined between a reversing roller 134, constituting a document reverse-conveying means, and outside guide plates 136, 138. Three driven rollers 135*a*, 135*b*, 135*c* press against the outer periphery of the reversing roller 134. Downstream of the first document sending-out path 130, a second document sending-out path 140 and a document reversing path 142 are provided in a bifurcated manner. At the bifurcated portion, a bifurcation controlling plate 144 is disposed. The second document sending-out path 140 is defined between the bifurcation controlling plate 144 and an outside guide plate 146. At the downstream end of the second document sending-out path 140, a discharge roller pair 152, consisting of a driving roller 148 and a driven roller 150, is disposed. On the second document sending-out path 140, a reflector type optical document detector SW8, composed of a light emitting element and a light receiving element, is disposed. The detector SW8 detects the document 50 passing along the second document sending-out path 140 and sends a detection signal to the control means to be described later on. The reversing path 142 is defined between the reversing roller 134 and the bifurcation controlling plate 144 and an outside guide plate 154, with its downstream end facing the downstream end of the document conveying path 108. On the document reversing path 142, a reflector type optical document detector SW9, composed of a light emitting element and a light receiving element, is disposed. The detector SW9 detects the document 50 passing along the document reversing path 142 and sends a detection signal to the control means to be described later on. The bifurcation controlling plate 144 has a middle portion mounted on a shaft 156 and is adapted to be operated by a solenoid SOL3. When the solenoid SOL3 is deenergized, the plate 144 is put to a position indicated by a solid line in FIG. 2 owing to the spring force of a return spring 158. When the solenoid SOL3 is energized, the plate 144 is placed at a position indicated by a two-dot chain line in FIG. 2 against the spring force of the return spring 158. Therefore, the document conveyed along the first document sending-out path 130 is sent to the second document sending-out path 140 when the solenoid SOL3 is deenergized, but is sent to the document reversing path 142 when the solenoid SOL3 is energized. The reversing roller 134 and the driving roller 148 constituting the discharge roller pair 152 are rotationally driven in directions shown by arrows 164 and 166 respectively, by a driving means 162 comprised of an electric motor M2 and a transmitting mechanism 160 such as a gear mechanism or an electric belt mechanism. To the electric motor M2 is mounted a rotational amount detecting means FG2, such as a rotary encoder or a frequency generator, which constitutes a means of detecting the amount of document conveyance. Pulse signals indicating detection of conveyance are sent to the control means to be described later on.

Figure 7:
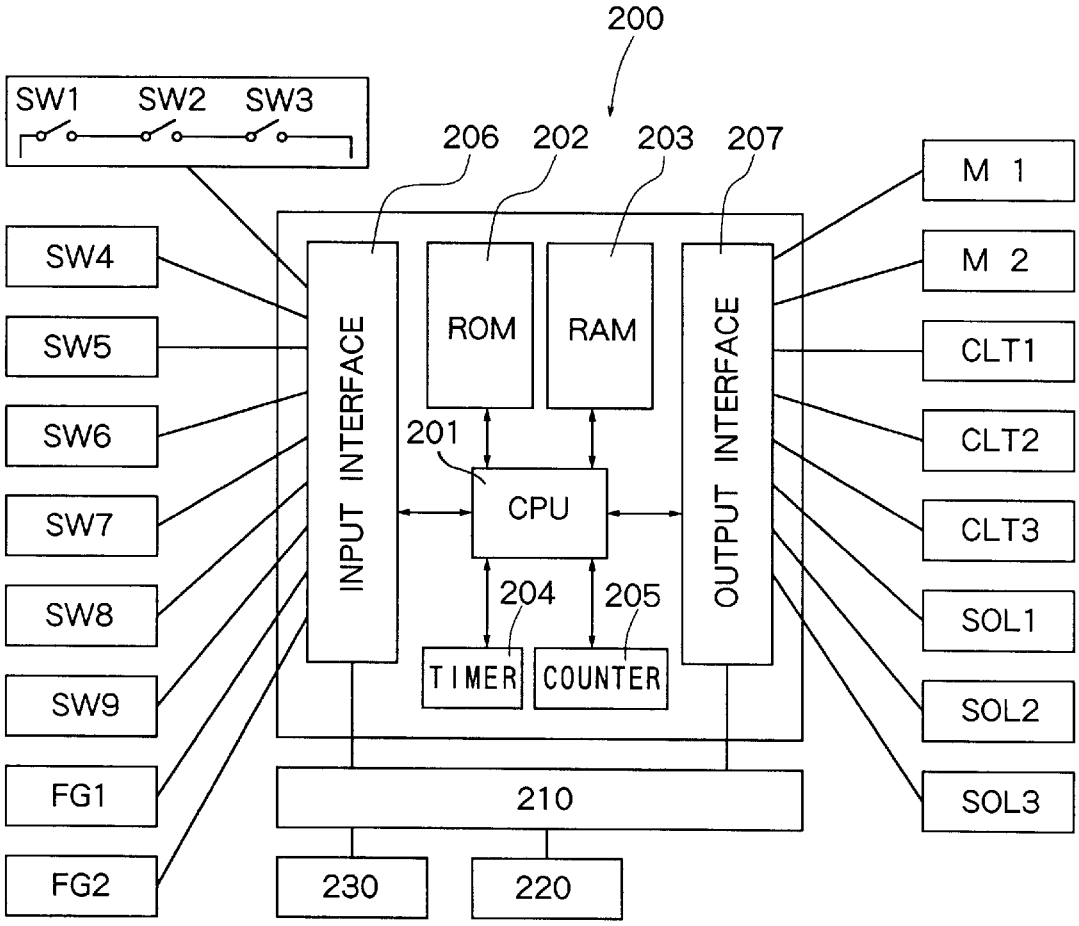
FIG. 7 is block diagram of a control means mounted on the automatic document feeder shown in FIGS. 1 and 2.

The automatic document feeder has a control means 200 shown in FIG. 7. The control means 200 is constituted by a microcomputer which has a central processing unit (CPU) 201 performing operations according to a control program, a read-only memory (ROM) 202 storing the control program and a control map, a random access memory (RAM) 203 storing the results of operations and being capable of reading and writing, a timer 204, a counter 205, an input interface 206, and an output interface 207. The input interface 206 of the so constituted control means 200 receives a detection signal from the safety switches SW1, SW2, SW3, and detection signals from the document setting switch SW4, the stopper position detecting means SW5, the reflector type optical detectors SW6, SW7, SW8, SW9, and the rotational amount detecting means FG1, FG2, while the output interface 207 puts out control signals to the electric motors M1, M2, the electromagnetic clutches CLT1, CLT2, CLT3, the solenoids SOL1, SOL3, and the latch type solenoid SOL2. The control means 200 is connected to a control means 210 of the electrostatic copying machine 2, so that control signals are exchanged between both control means. To the control means 210 of the electrostatic copying machine 2, an operating means 220 and a display means 230 are connected. As shown in FIG. 1, the operating means 220 is placed on the top of a front part of the electrostatic copying machine 2, and includes operating keys for a copy action, such as a key for two-document exposure setting as a two-document exposure setting means, a key for document overlap amount setting as a document overlap amount setting means, a key for starting copying, a key for designating the number of copies, a key for designating copying of both surfaces of the document, and a key for stopping a copy action. Through these keys, the operating means 220 enters copying information into the control means 210 of the electrostatic copying machine 2. The display means 230 is disposed, similar to the operating means 220, on the top of the front part of the electrostatic copying machine 2 and adjacent to the operating means 220 to show information on copying, information on troubles, and so forth.

Figure 8:
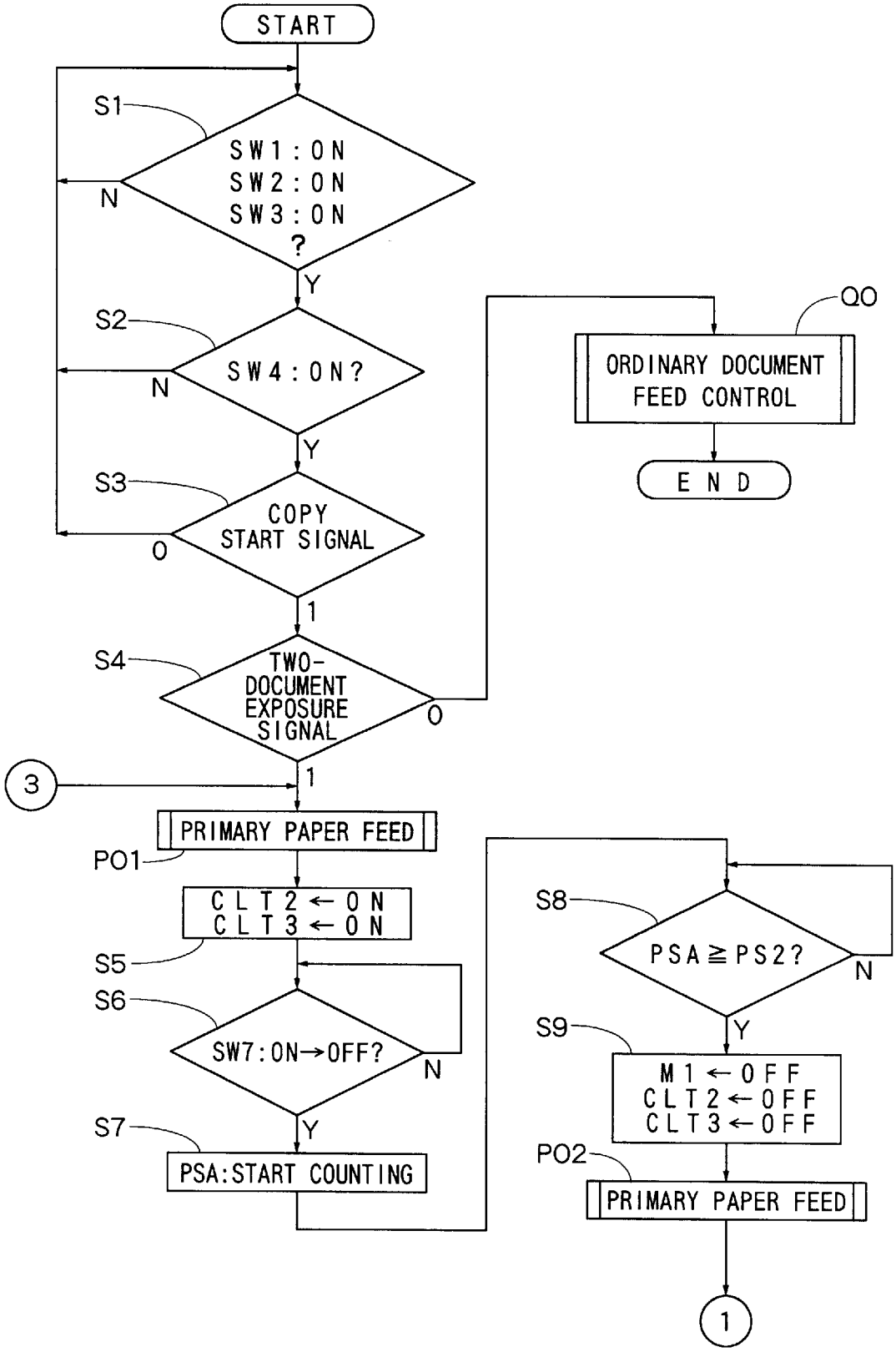
FIG. 8 is a flow chart showing a part of a main routine representing a processing procedure of the control means shown in FIG. 7.
Figure 9:
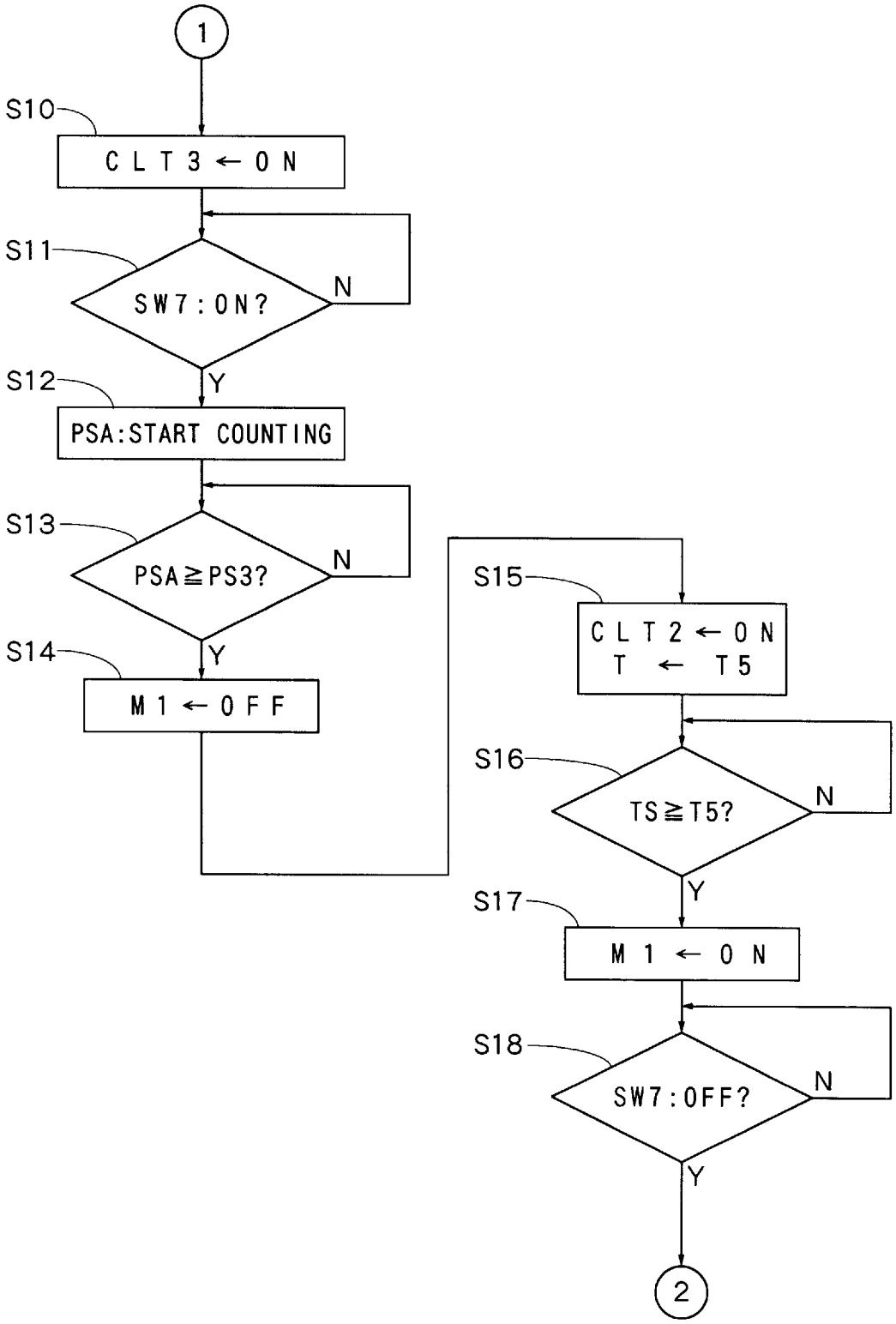
FIG. 9 is a flow chart showing another part of the main routine representing the processing procedure of the control means shown in FIG. 7.
Figure 10:
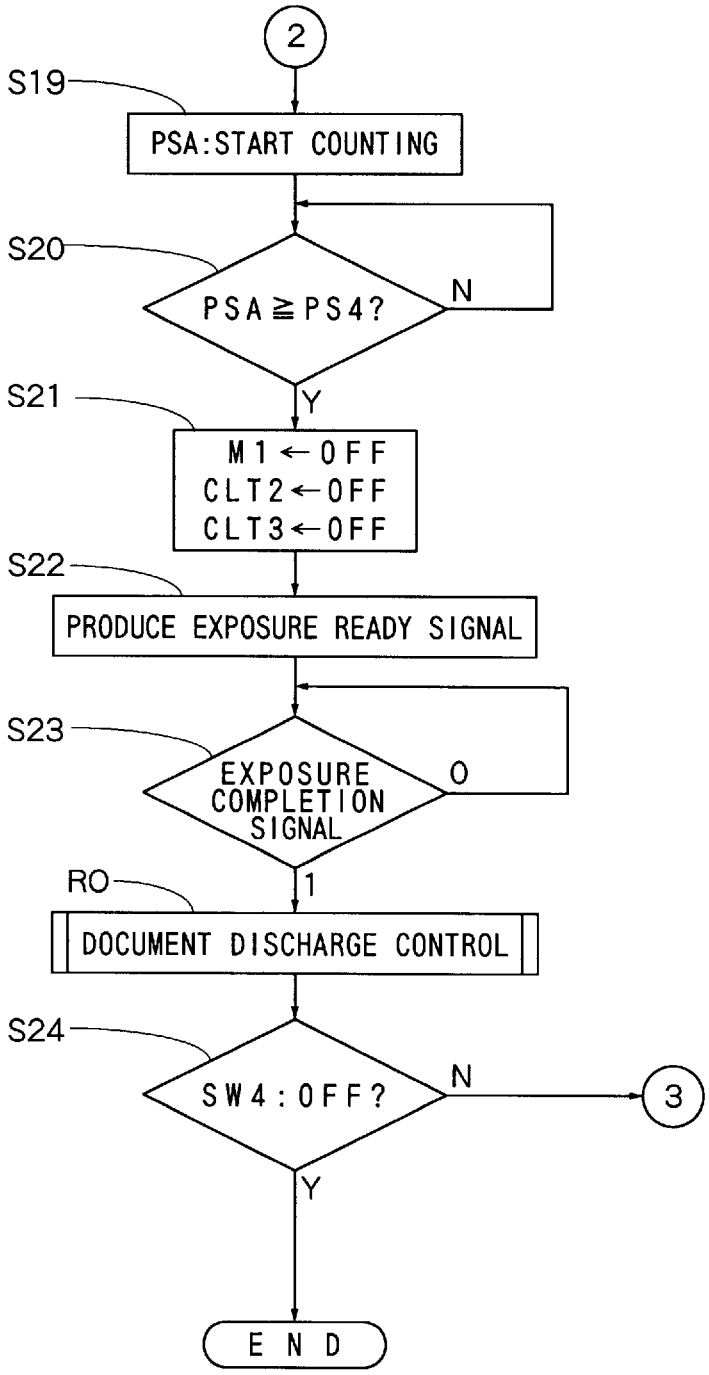
FIG. 10 is a flow chart showing another part of the main routine representing the processing procedure of the control means shown in FIG. 7.
Figure 11:
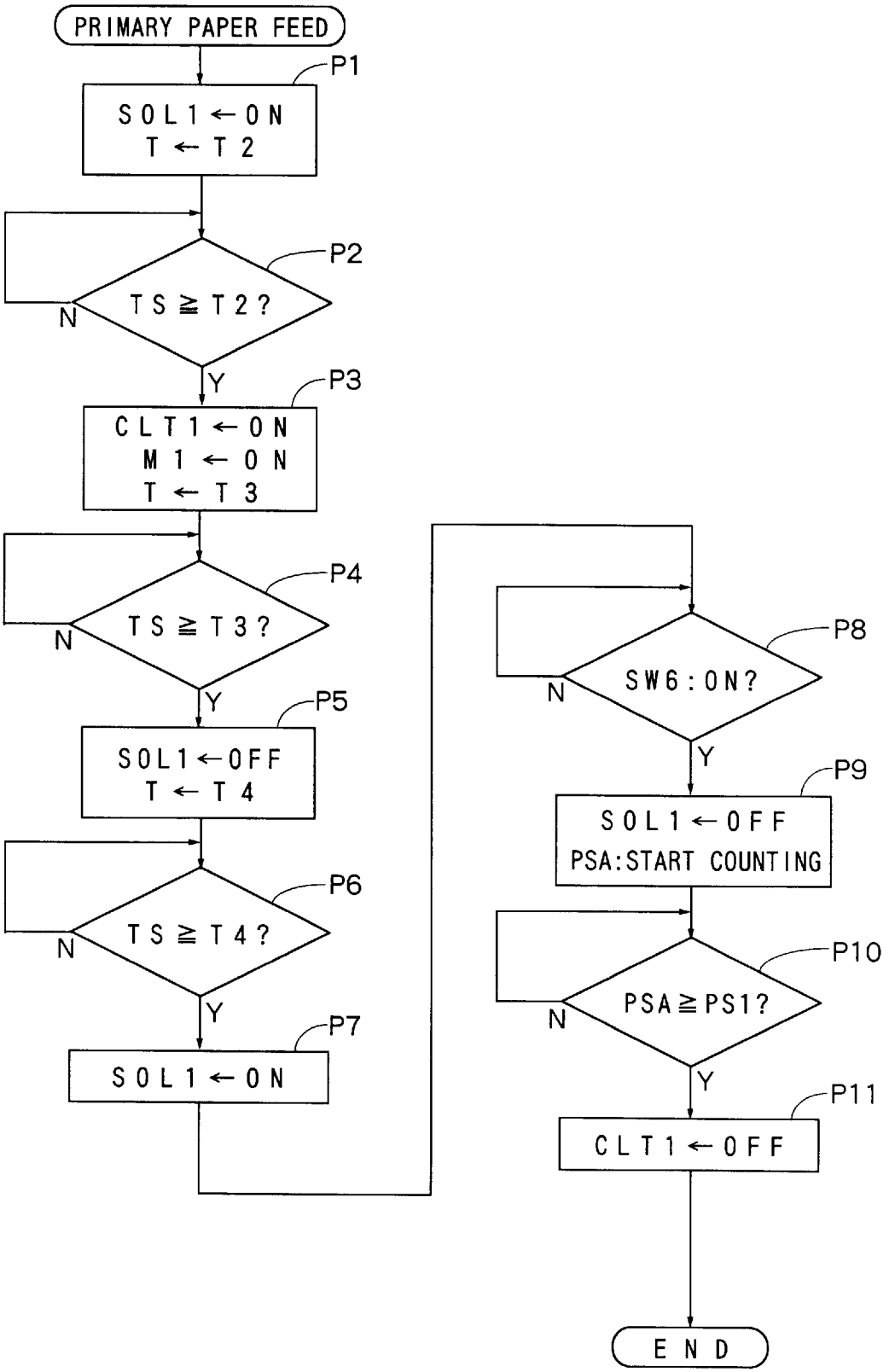
FIG. 11 is a flow chart showing a subroutine for primary paper feed control, representing the processing procedure of the control means shown in FIG. 7.
Figure 12:
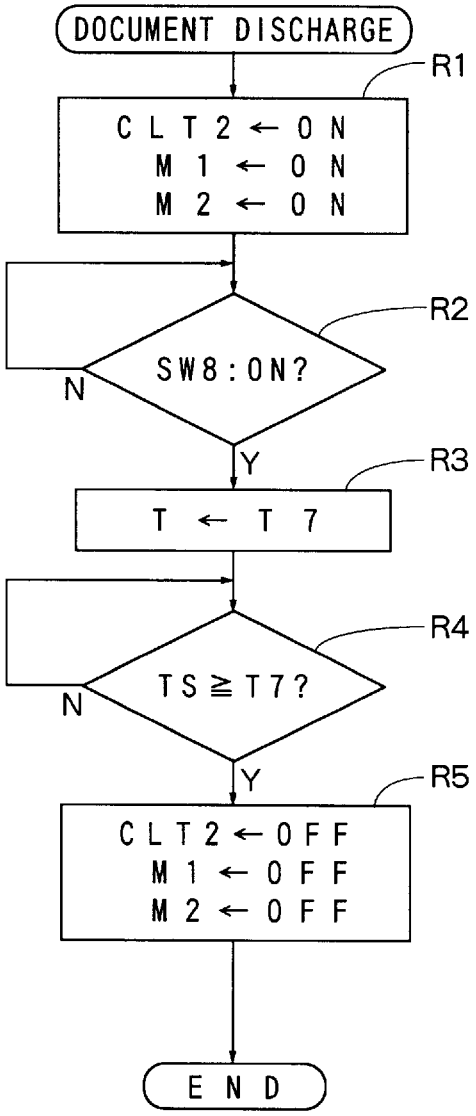
FIG. 12 is a flow chart showing a subroutine for document discharge control, representing the processing procedure of the control means shown in FIG. 7.

The automatic document feeder according to the illustrated embodiment is constituted as described above. The operating procedure for it will be described with reference to flow charts shown in FIGS. 8 to 12. FIGS. 8 to 10 show a main routine, FIG. 11 shows a subroutine for primary paper feed control, FIG. 12 shows a subroutine for document discharging control.

The control means 200 checks, at step S1 of the main routine shown in FIGS. 8 to 10, whether the safety switches SW1, SW2 and SW3 are all ON or not. That is, it will be dangerous if the automatic document feeder 4 is actuated while the feeder 4, the left end portion cover 30, or the right end portion cover 32 is open. This is a checking for prohibiting the actuation of the automatic document feeder 4 if any one of them is open. Thus, if any one of the safety switches SW1, SW2 and SW3 is OFF at step S1, the device 4 enters the wait state until the cover is brought to the closed position. With all switches ON, the procedure goes to step S2 to determined whether the document setting switch SW4 is ON, i.e., whether documents are placed on the document bearing means 18. If the document setting switch SW4 is not ON, the procedure returns to step S1 based on the judgment that no document has been placed on the document bearing means 18. When the document setting switch SW4 is ON at step S2, the procedure goes to step S3 based on judgment that documents have been placed on the document bearing means 18. At this step, the control means 200 checks whether a copy start signal has been sent by the control means 210 of the electrostatic copying machine 2. The copy start signal is sent from the control means 210 to the control means 200 when entered by the operator from the copy start key of the operating means 220. No receipt of the copy start signal means no need for copying, and results in return to step 1. Upon receipt of the copy start signal at step S3, the control means 200 goes to step S4 to check whether a two-document exposure (so-called two-in-one function) signal is sent from the control means 210 of the electrostatic copying machine 2. This two-document exposure signal is sent from the control means 210 to the control means 200 when entered by the operator from the two-document exposure setting key of the operating means 220. At the step S4, in the case of no receipt of the two-document exposure signal from the control means 210 of the electrostatic copying machine 2, the procedure goes to step Q0 to perform an ordinary document feed control in which documents are sent one by one onto the stationary plate 34. At the step S4, if the two-document exposure signal is sent from the control means 210 of the electrostatic copying machine 2, the procedure goes to step P01 to perform a primary paper feed control.

Next, a subroutine for primary paper feed control shown in FIG. 11 will be described. The control means 200 energizes the solenoid SOL1 at step P1 to actuate the pressing plate 48 and make it press the top of the documents 50 placed on the document bearing means 18 and inserted onto the stationary plate 34. In addition, the control means 200 sets the timer T to T2. The set time T2 is the time required from the issue of the energizing signal by the control means 200 to the solenoid SOL1 until the placement of the pressing plate 48 on the document bearing means 18 and its pressing of the top of the documents 50. The set time T2 may be set, for example, to 100 msec. After setting the timer T to T2, the control means 200 goes to step P2, and checks whether the time, TS that has elapsed since the setting of the timer T to T2 has reached the set time T2. If the elapsed time TS has not reached the set time T2, the control means 200 is placed in the wait state. If the elapsed time TS has reached the set time T2, the control means 200 proceeds to step P3 based on the judgment that the documents 50 have been placed on the document bearing means 18 and reliably pressed by the pressing plate 48. At this step, the control means 200 turns on the electromagnetic clutch CLT1, and drives the electric motor M1. Turning on the electromagnetic clutch CLT1 and driving the electric motor M1 result in the rotational driving of the forwarding roller 40, the paper feed roller 64 constituting the document separating means 60 together with the separating belt mechanism 66, and the driving roller 68 of the separating belt mechanism 66. Thus, the bottom-most document in the document stack placed on the document bearing means 18 and inserted onto the stationary plate 34 is fed to the document sending-in path 98. Simultaneously with turning on the electromagnetic clutch CLT1 and driving the electric motor M1 to start the conveyance of the documents 50 placed on the document bearing means 18, the control means 200 sets the timer T to T3. The set time T3 is the time required from the start of the conveyance of the document 50 until the passage of the front end of the document through the nip portion between the paper feed roller 64 and the separating belt mechanism. The set time T3 may be set, for example, to 160 msec.

After setting the timer T to T3, at the step P3, the control means 200 goes to step P4 and checks whether the time, TS, that has elapsed since the setting of the timer T to T3 has reached the set time T3. If the elapsed time TS has not reached the set time T3, the control means 200 is placed in the wait state. If the elapsed time TS has reached the set time T3, the control means 200 proceeds to step P5 to deenergize the solenoid SOL1. Upon deenergizing of the solenoid SOL1, the pressure by the pressing plate 48 on the documents 50 laid on the document bearing means 18 is released. Hence, in the case of a deflection occurring in the second or later document owing to its friction with the first document being conveyed, this friction is removed, so that the second or later document returns to its original shape owing to its elasticity without getting wrinkled. When the solenoid SOL1 is deenergized and the pressure on the documents 50 by the pressing plate 48 is released, the conveying power of the forwarding roller 40 is eliminated. In this state, the document is carried only by the paper feed roller 64. Simultaneously with deenergizing the solenoid SOL1 to release the pressure on the documents 50 by the pressing plate 48, the control means 200 sets the timer T to T4. The set time T4 is the time required for the second or later document deflected by its friction with the first document being conveyed to return to its original shape because the pressure by the pressing plate 48 is released. The set time T4 may be set, for example, to 200 msec. After setting the timer T to T4, the control means 200 goes to step P6 and checks whether the time, TS, that has elapsed since the setting of the timer T to T4 has reached the set time T4. If the elapsed time TS has not reached the set time T4, the control means 200 is placed in the wait state. If the elapsed time TS has reached the set time T4, the control means 200 proceeds to step P7 to energize the solenoid SOL1 again. Upon energizing of the solenoid SOL1, the pressure on the documents 50 by the pressing plate 48 appears, thereby restoring the conveying power of the forwarding roller 40. Thus, the document is conveyed by the conveying power of the forwarding roller 40 and the paper feed roller 64.

After energizing the solenoid SOL1 again at the step P7, the control means 200 moves on to step P8, checking whether the detector SW6 is ON or not, i.e., whether the front end of the document fed to the document sending-in path 98 has reached the detector SW6 or not. If the detector SW6 is not ON at step P8, the control means 200 is placed in the wait state. If the detector SW6 is ON, the control means 200 goes to step P9 to deenergize the solenoid SOL1, thereby releasing the pressure on the documents 50 by the pressing plate 48. At the same time, the control means 200 starts counting the pulse signals, PSA, from the rotational amount detecting means FG1 mounted on the electric motor M1. After starting the counting of the pulse signals PSA at step P9, the control means 200 goes to step P10 to check whether the pulse signals PSA have reached the set number of pulses, PS1. The set number of pulses PS1 corresponds to the amount of rotation of the electric motor M1 which in turn corresponds to the amount of conveyance of the document during the period from the time of its front end passing along the detector SW6 until its contact with the nip portion of the register roller pair 114 and its slight bending. If the pulse signals PSA have not reached the set pulse number PS1 at step P10, the control means 200 waits and continues document conveyance. If the pulse signals PSA have reached the set pulse number PS1, a judgment is made that the front end of the document has been brought into contact with the nip portion of the register roller pair 114. Based on this judgment, the electromagnetic clutch CLT1 is put in the OFF state at step P11 to stop the paper feeding action for the document. As a result of this primary paper feed, the document fed to the document sending-in path 98 by the forwarding roller 40 and the document separating means 60 has its front end contacted with the nip portion of the register roller pair 114 which is in the non-operating state. Thus, the primary paper feed of the first document comes to an end.

Figure 6:
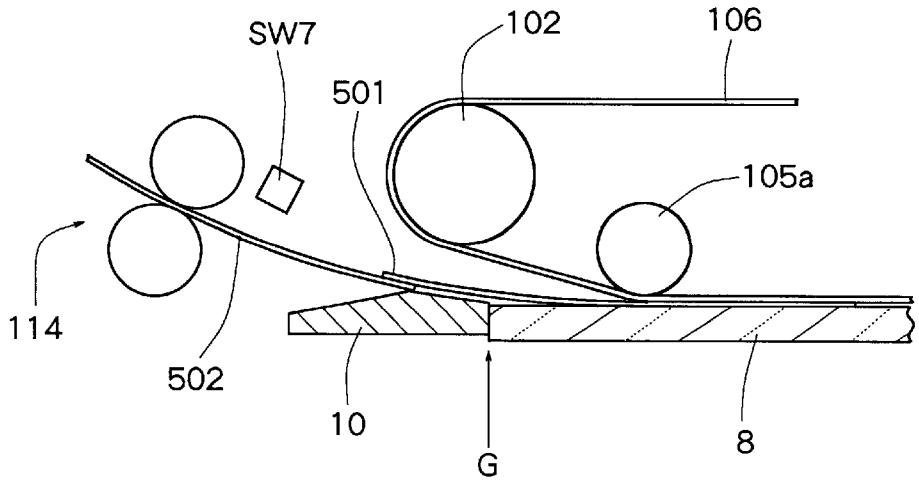
FIG. 6 is an explanatory drawing showing the conveying of two documents to an exposure position in the automatic document feeder shown in FIG. 1.

After the end of the primary paper feed, the control means 200 goes to the step S5 of the main routine shown in FIGS. 8 to 10 to turn the electromagnetic clutches CLT2 and CLT3 on. When the CLT2 and CLT3 are on, the conveying belt mechanism 100 and the register roller pair 114 are actuated. Thus, the first document, conveyed to the nip portion of the register roller pair 114 in the process of the primary paper feed, is conveyed toward the document conveying path 108 extending along the transparent platen 8 of the electrostatic copying machine 2. After turning on the electromagnetic clutches CLT2 and CLT3 at step S5, the control means 200 goes to step S6 to check whether the detector SW7 becomes ON and then OFF. That is, it is checked whether the document conveyed to the nip portion of the register roller pair 114 has been conveyed toward the document conveying path 108, its front end has passed beside the detector SW7, and its rear end has passed by the detector SW7. At step S6, if the detector SW7 is not turned off after being turned on, this means that the rear end of the document has not passed the detector SW7, so that the control means 200 enters the wait state. If the detector SW7, after becoming ON, becomes OFF, a judgment is made that the rear end of the document has passed the detector SW7. Thus the procedure goes to step S7 to start the counting of the pulse signals PSA from the rotational amount detecting means FG1 mounted on the electric motor M1. After beginning the counting of the pulse signals PSA at step S7, the control means 200 goes to step S8 to check whether the pulse signals PSA have reached the set number of pulses PS2. The set number of pulses PS2 corresponds to the amount of rotation of the electric motor M1 corresponding to the amount of conveyance of the document, as shown in FIG. 6, during the period from the time of the rear end of the first document 501 passing the detector SW7 until its reaching a predetermined position on the upstream side of the conveying belt mechanism 100. At step S8, if the pulse signals PSA have not reached the set number of pulses PS2, the control means 200 waits and continues document conveyance. When the pulse signals PSA have reached the set number of pulses PS2, the control means 200 determines that the rear end of the first document has reached the predetermined position. Thus, the control means 200 goes to step S9 to turn off the electric motor M1 and electromagnetic clutches CLT2 and CLT3, and transiently stop conveying the first document 501. Thus, the first document 501 waits at the position shown in FIG. 6.

After feeding the first document 501 with its rear end being brought to the predetermined position upstream of the conveying belt mechanism 100, as described above, the control means 200 goes to step P02 to perform the primary paper feed control of the second document. This primary paper feed control is the same as the subroutine of the primary paper feed control shown in FIG. 11. By performing the second primary paper feed control (step P02), the front end of the second document is brought into contact with the nip portion of the register roller pair 114 which is in the non-operating state.

After finishing the primary paper feed of the second document, the control means 200 goes to step S10 in the main routine shown in FIGS. 8 to 10, to turn on the electromagnetic clutch CLT3. When the electromagnetic clutch CLT3 becomes ON, the register roller pair 114 is actuated. Thus, the second document, conveyed to the nip portion of the register roller pair 114 in the process of the primary paper feed, is fed toward the document conveying path 108 extending along the transparent platen 8 of the electrostatic copying machine 2. After turning on the electromagnetic clutch CLT3 at step S10, the control means 200 goes to step S11 to check whether the detector SW7 is on or not. That is, it is checked whether the second document fed to the nip portion of the register roller pair 114 has been conveyed toward the document conveying path 108, and its front end has reached the detector SW7. If the detector SW7 is not on at step S11, this means that the front end of the document has not reached the detector SW7, so that the control means 200 is placed in the wait state. If the detector SW7 is ON, a judgment is made that the front end of the document has reached the detector SW7. Thus, the control means 200 goes to step S12 to start the counting of the pulse signals PSA from the rotational amount detecting means FG1 mounted on the electric motor M1. After beginning the counting of the pulse signals PSA at step S12, the control means 200 goes to step S13 to check whether the pulse signals PSA have reached the set number of pulses PS3. This set number of pulses PS3 corresponds to the amount of rotation of the electric motor M1 corresponding to the amount of conveyance of the document, as shown in FIG. 6, during the period from the time of the front end of the second document 502 passing by the detector SW7 until its reaching the predetermined position downstream by a predetermined amount from the rear end of the first document 501 waiting as described above. At step S13, if the pulse signals PSA have not reached the set number of pulses PS3, the control means 200 waits and continues document conveyance. After the pulse signals PSA have reached the set number of pulses PS3, the control means 200 judges that the front end of the second document has reached the predetermined position, and goes to step S14 to turn the electric motor M1 off. By this procedure, the front end of the second document 502 overlaps the rear end of the first document 501 as shown in FIG. 6. The amount of the overlap has been set, for example, at the predetermined value in the range from 0.5 to 1.0 mm, if the document overlap amount has not been set by the document overlap amount setting key as the document overlap amount setting means provided on the operating means. In the illustrated embodiment, exposure is performed rightward from the document setting reference position G side (the left end of the transparent platen 8 in FIG. 2). Desirably, therefore, the front end of the second document 502 overlaps the underside of the rear end of the first document 501. Thus, in the embodiment illustrated, the document restraining member 10 is formed such that its top surface inclines downward toward the end on the upstream side (the left side in FIG. 2).

After turning the electric motor M1 off at step S14, the control means 200 goes to step S15 to turn the electromagnetic clutch CLT2 on and to set the timer T to T5. The set time T5 is the time required from the time of the electromagnetic clutch CLT2 becoming ON until a complete connection is achieved. The set time T5 may be set, for example, to 30 msec. After turning on the electromagnetic clutch CLT2 and setting the timer T to T5 at step S15, the control means 200 goes to step S16, and checks whether the time, TS, that has elapsed since the setting of the timer T to T5 has reached the set time T5. If the elapsed time TS has not reached the set time T5, the control means 200 is placed in the wait state. If the elapsed time TS has reached the set time T5, the control means 200 proceeds to step S17 to drive the electric motor M1. By this procedure, the conveying belt mechanism 100 and the register roller pair 114 are driven simultaneously, whereby the first document 501 and the second document 502 are fed onto the transparent platen 8 while being kept in the relative relationship shown in FIG. 6.

After driving the electric motor M1 at step S17, the control means 200 proceeds to step S18 to check whether the detector SW7 is OFF, that is, the rear end of the second document 502 has passed the detector SW7. That the detector SW7 is not OFF means that the rear end of the second document 502 has not passed the detector SW7, so that the control means 200 is placed in the wait state. If the detector SW7 is OFF, the control means 200 judges that the rear end of the second document 502 has passed the detector SW7. Thus, the control means 200 goes to step S19 to start the count of the pulse signals PSA from the rotational amount detecting means FG1 mounted on the electric motor M1. After beginning the counting of the pulse signals PSA at step S19 the control means 200 goes to step S20 to check whether the pulse signals PSA have reached the set number of pulses PS4. This set number of pulses PS4 corresponds to the amount of rotation of the electric motor M1 corresponding to the amount of conveyance of the document during the period from the time of the rear end of the second document 502 passing the detector SW7 until its reaching the document setting reference position G. When the documents are set with the front end of the second document 502 and the rear end of the first document 501 overlapping, and with the rear end of the second document aligning with the document setting reference position G, the rear end of the first document 501 is situated nearer to the second document 502 side than to the central position. Thus, by conveying the first document 501 and the second document 502 downstream in the direction of document feeding from the document setting reference position G by an amount corresponding to a half of the amount of overlap, images of both documents can be copied on the center of the transfer sheet. This is effective particularly when a large amount of overlap has been set by the document overlap amount setting key provided on the operating means 220. At step S20, if the pulse signals PSA has not reached the set number of pulses PS4, the control means 200 continues document conveyance. When the pulse signals PSA have reached the set number of pulses PS4, the control means 200 judges that the rear end of the second document has reached the document setting reference position G. Thus, the control means 200 goes to step S21 to turn off the electric motor M1 and the electromagnetic clutches CLT2 and CLT3. As a result, the conveying belt mechanism 100 and the register roller pair 114 stop, so that the first document 501 and the second document 502 are set on the transparent platen 8 with the rear end of the second document being situated at the document setting reference position G. After setting the first document 501 and the second document 502 on the transparent platen 8 in this manner, the control means 200 goes to step S22 to put out an exposure ready signal to the control means 210 of the electrostatic copying machine 2. The control means 210 of the electrostatic copying machine 2, which has received this exposure ready signal, performs a copying action. The control means 200 goes to step S23 to check whether an exposure completion signal has been received from the control means 210 of the electrostatic copying machine 2. This exposure completion signal is sent from the control means 210 of the electrostatic copying machine 2 to the control means 200 when the exposure of the document conveyed onto the transparent platen 8 is completed. The absence of the exposure completion signal at step S23 means that the exposure action has not been completed. Thus, the control means 200 is placed in the wait state. In the presence of the exposure completion signal, the control means 200 judges that the exposure action has been completed. Thus, the control means 200 goes to step R0 to perform a subroutine for discharge of the first document 501 and the second document 502 on the transparent platen 8.

Next, document discharge control will be described referring to a flow chart shown in FIG. 12. The control means 200, after receiving the exposure completion signal from the control means 210 of the electrostatic copying machine 2 at step S24, turns on the electromagnetic clutch CLT2, drives the electric motor M1, and drives the electric motor M2 (step R1). This actuates the conveying belt mechanism 100 and also rotationally drives the reversing roller 134 and the discharge roller 148, thereby performing a discharge action of the document on the transparent platen 8 that has completed exposure. By this discharge action, the document on the transparent platen 8 that has completed exposure is conveyed on the transparent platen 8 rightward in FIG. 2 and is further carried to the second document sending-out path 140 by way of the first document sending-out path 130. After turning the electromagnetic clutch on, driving the electric motor M1, and driving the electric motor M2 at step R1 to start the document discharge action, the control means 200 moves on to step R2. At this step, the control means 200 checks whether the document detector SW8 disposed along the second document sending-out path 140 has become OFF after becoming ON, i.e., whether the first document 501 and the second document 502 conveyed to the second document sending-out path 140 have reached the document detector SW8 and the rear end of the second document 502 has passed beyond the detector SW8. If the detector SW8 has not become OFF after becoming ON, the control means 200 is placed in the wait state. If the detector SW8 has become OFF after becoming ON, a judgment is made that the rear end of the second document 502 has passed beyond the document detector SW8. Based on this judgment, the control means 200 proceeds to step R3 to set the timer T to T7. This set time T7 is the time from the passage of the rear end of the second document 502 beyond the document detector SW8 until its passage through the discharge roller 148. It has been set, for example, to 100 msec. After setting the timer T to T7 at step R3, the control means 200 goes to step R4 to see whether the time TS that has elapsed since the rear end of the second document 502 has passed beyond the document detector SW8 has reached the set time T7. In case the elapsed time TS is less than the set time T7, the document discharge action is continued. When the elapsed time TS is not less than the set time T7, a judgment is made that the rear end of the second document 502 has passed the discharge roller 148. Based on this judgment, the control means 200 goes to step R5, where it turns off the electromagnetic clutch CLT2 and stops the electric motors M1 and M2. The exposed document thus discharged from the discharge roller 148 is placed on the document discharge tray 20.

As described above, after performing the document discharge control, the control means 200 goes to step S24 to check whether the document setting switch SW4 is OFF, that is, the documents borne on the document bearing means 18 have all been fed. The document setting switch SW4 not being OFF means that documents borne on the document bearing means 18 still remain, so that the control means 200 returns to step P01 to repeat each step described above. If the document setting switch SW4 is OFF, the control means 200 judges that the documents borne on the document bearing means 18 have all been fed. Thus, the control means 200 completes a copy action.

The automatic document feeder of the present invention is composed as above wherein when the two-document exposure setting means sets the conveyance of two documents to the exposure position and the simultaneous exposure of the two documents, the control means controls the document sending-in means, the register roller pair and the document conveying means so as to be actuated, thereby to feed the first document borne on the document bearing means, situate its rear end at a predetermined position between the register roller pair and the document conveying means, and place it in the wait state;

then controls the document sending-in means and the register roller pair to be actuated, thereby to feed the second document borne on the document bearing means, situate its front end at a position where the front end overlaps the rear end of the first document by a predetermined amount; and then controls the register roller pair and the document conveying means to be actuated, thereby to convey the first and second documents, situating them at the exposure position.

Thus, the first and second documents can be exposed, with the front end of the second document and the rear end of the first document overlapping by a predetermined amount. Hence, no gap occurs between the first document and the second document. This can prevent the occurrence of the so-called black line in which the shadow of the rear end of the first document appears vertically at the center of the transfer paper at the time of exposure.

The control means of the present invention, when conveying the first and second documents to the exposure position, situates the rear end of the second document downstream of the document setting reference position in the direction of document feeding by an amount corresponding to a half of the amount of the overlap. Thus, images of both documents can be copied on the center of a transfer sheet.

Further, the automatic document feeder of the present invention is equipped with the document overlap amount setting means for setting the amount of overlap between the rear end of the first document and the front end of the second document, and the control means controls the first and second documents to be conveyed based on the amount of overlap set by the document overlap amount setting means. Thus, the copying position can be changed arbitrarily according to the positions of images on the first and second documents.

What I claim is:

1. An automatic document feeder for an image processing means having a document feed path, said automatic document feeder comprising document bearing means, for bearing documents to be fed; document sending-in means, for feeding a document borne on the document bearing means to the document feed path; a register roller pair disposed on the document feed path downstream of the document sending-in means, for temporarily stopping the document fed by the document sending-in means and carrying the stopped document toward an exposure position for exposure of the document; document conveying means, for conveying the document carried by the register roller pair to the exposure position and for discharging the document from the exposure position after exposure of the document; two-document exposure setting means, for setting the simultaneous exposure of two documents; and control means, for controlling the document sending-in means, the register roller pair, and the document conveying means so that when the two-document exposure setting means sets the simultaneous exposure of two documents, then:

the document sending-in means, the register roller pair and the document conveying means feed the first document borne on the document bearing means, situate the rear end of said first document at a predetermined position between the register roller pair and the document conveying means, and place said first document in a first wait position, the document sending-in means and the register roller pair feed the second document borne on the document bearing means, and situate the front end of said second document at a second wait position in which the front end of said second document overlaps the rear end of said first document by a predetermined amount, and the register roller pair and the document conveying means convey said first and second documents to situate said first and second documents at the exposure position with the front end of said second document overlapping the rear end of said first document by the predetermined amount.

2. The automatic document feeder of claim 1, wherein in the exposure position, the rear end of the second document is situated downstream of a document setting reference position in the direction of document feeding by an amount corresponding to one half of the predetermined amount.

3. The automatic document feeder of claim 1, further comprising document overlap amount setting means for setting the predetermined amount, and wherein the control means controls the register roller pair and the document conveying means to convey said first and second documents based on the set predetermined amount.

4. An automatic document feeder for an image processing means having a document feed path, said automatic document feeder comprising document bearing means, for bearing documents to be fed; document sending-in means, for feeding a document borne on the document bearing means to the document feed path; a register roller pair disposed on the document feed path downstream of the document sending-in means, for temporarily stopping the document fed by the document sending-in means and carrying the stopped document toward an exposure position for exposure of the document; document conveying means, for conveying the document carried by the register roller pair to the exposure position and for discharging the document from the exposure position after exposure of the document; two-document exposure setting means, for setting the simultaneous exposure of two documents; and control means, for controlling the document sending-in means, the register roller pair, and the document conveying means so that when the two-document exposure setting means sets the simultaneous exposure of two documents, then:

the document sending-in means, the register roller pair and the document conveying means feed the first document borne on the document bearing means, and situate said first document at a first wait position, the document sending-in means and the register roller pair feed the second document borne on the document bearing means, and situate said second document at a second wait position, and the register roller pair and the document conveying means situate said first and second documents at the exposure position with the front end of said second document overlapping the rear end of said first document by a predetermined amount.

5. The automatic document feeder of claim 4, wherein in the exposure position the rear end of the second document is situated downstream of a document setting reference position in the direction of document feeding by an amount corresponding to one half of the predetermined amount.

6. The automatic document feeder of claim 4, further comprising document overlap amount setting means for setting the predetermined amount, and wherein the control means controls the register roller pair and the document conveying means to convey said first and second documents based on the set predetermined amount.

7. The automatic document feeder of claim 4, wherein when said second document is in the second wait position, the front end of the second document overlaps the rear end of the first document by the predetermined amount.

* * * * *